US008534177B2

(12) United States Patent
Kalms et al.

(10) Patent No.: US 8,534,177 B2
(45) Date of Patent: Sep. 17, 2013

(54) SYSTEM AND METHOD FOR SHOCK ISOLATION IN A LAUNCH SYSTEM

(75) Inventors: William Kalms, Parkville, MD (US); Tejbir Arora, Bel Air, MD (US); John Snediker, Felton, PA (US)

(73) Assignee: Lockheed Martin Corporation, Bethesda, MD (US)

( * ) Notice: Subject to any disclaimer, the term of this patent is extended or adjusted under 35 U.S.C. 154(b) by 313 days.

(21) Appl. No.: 12/715,063

(22) Filed: Mar. 1, 2010

(65) Prior Publication Data

US 2012/0104219 A1 May 3, 2012

(51) Int. Cl.
*F41F 3/04* (2006.01)

(52) U.S. Cl.
USPC ..... 89/1.816; 89/1.817; 102/293; 248/560; 248/603; 248/618

(58) Field of Classification Search
USPC ..... 248/560, 576, 574, 603, 608, 622, 248/618; 89/1.817, 1.184, 1.816; 102/293
See application file for complete search history.

(56) References Cited

U.S. PATENT DOCUMENTS

| | | | | |
|---|---|---|---|---|
| 3,242,809 | A * | 3/1966 | Bauer | 89/1.8 |
| 3,368,452 | A * | 2/1968 | Fredrickson et al. | 89/1.816 |
| 4,492,143 | A * | 1/1985 | Ruhle | 89/1.816 |
| 4,665,792 | A * | 5/1987 | Gassler et al. | 89/1.816 |
| 4,878,416 | A * | 11/1989 | Orquera et al. | 89/1.81 |
| 5,220,125 | A | 6/1993 | Huber | |
| 5,327,809 | A | 7/1994 | Matteson et al. | |
| 6,659,438 | B2 | 12/2003 | Michael et al. | |
| 2009/0126556 | A1 | 5/2009 | Skurdal et al. | |

OTHER PUBLICATIONS

International Search Report dated Nov. 22, 2011 for related International application No. PCT/US2011/026699.

* cited by examiner

*Primary Examiner* — Amy J Sterling
(74) *Attorney, Agent, or Firm* — Howard IP Law Group, PC

(57) ABSTRACT

A system and method for providing a munitions launching system with dynamic shock isolation in which a spring plate skirt having an integral spring arrangement is provided between a munitions frame and a munitions extension, the spring plate skirt defining an opening that provides for the uninterrupted flow of expelled rocket gases, as well as underside access to the munitions frame.

25 Claims, 7 Drawing Sheets

SYSTEM AND METHOD FOR SHOCK ISOLATION IN A LAUNCH SYSTEM

FIELD OF THE INVENTION

The present invention relates to shock isolation systems used in missile and munitions launchers.

BACKGROUND

Modern warships use multi-cell munitions launchers (MCL), such as the U.S. Navy's Vertical Launch System (VSL), as their primary offensive and defensive weapons. In order to reduce the high cost associated with MCL-related modifications, munitions launching systems have become increasingly integrated and reconfigurable. Adaptable launch systems (ALS), such as those described in U.S. Patent App. Pub. No. 2009/0126556, allow existing MCLs to be quickly reconfigured to accept a wide range of "All Up Round" (AUR) missiles and munitions, thus eliminating the need for costly MCL canister development and retrofitting.

A key component of an ALS is the munitions adapter. The munitions adapter is the primary physical support and shock isolating structure for a variety of missiles and munitions launchable from these systems. Accordingly, adapter design characteristics include shock isolation, high heat resistance, adequate gas management characteristics, and access to the underside of the munitions mounted thereto. Many of these factors become even more important in the event of a restrained firing (e.g. failure of a missile to leave its firing canister despite the ignition of its motor).

Current munitions adapters comprise complex, costly assemblies that utilize shock isolators such as coil springs and/or tubular shock absorbers. These arrangements provide limited shock isolation in space-constrained environments with reduced underside access to the munitions. These arrangements also tend to obstruct the flow of rocket motor gases during a restrained firing, thereby creating a significant risk of damage to the launchers and related hardware, as well as physical damage to items in close proximity to misfiring missiles. Moreover, maintenance and repair operations are hindered in that it is difficult and time consuming to change out assemblies in the event of damage, or as part of a changeover in the munitions-type being used.

Designs offering improved rocket gas flow, dynamic shock isolation, underside access and support, as well as substantially reduced costs, complexity, and replacement time are desirable.

SUMMARY

In one embodiment of the present invention, a munitions adapter includes a munitions frame resiliently mounted to a munitions extension by a shock isolator arranged there between. The shock isolator includes an opening configured to allow the passage of expelled rocket motor gases. The shock isolator provides a tunable spring response between the munitions extension and the munitions frame, and underside access to the munitions frame.

In another embodiment of the present invention, a munitions adapter includes a munitions frame resiliently mounted to a munitions extension by a spring plate skirt structure. The spring plate skirt comprises an integral spring arrangement and defines an opening for the uninterrupted passage of expelled rocket motor gases. The spring plate skirt provides a tunable spring structure between the munitions extension and the munitions frame, while providing underside access to the munitions frame.

A system and method for providing a munitions launching system with dynamic shock isolation in which a spring plate skirt having an integral spring arrangement is provided between a munitions frame and a munitions extension, the spring plate skirt defining an opening that provides for the uninterrupted flow of expelled rocket gases, as well as underside access to the munitions frame.

DETAILED DESCRIPTION OF PREFERRED EMBODIMENTS

Reference will now be made in detail to the present exemplary embodiments of the invention, examples of which are illustrated in the accompanying drawings.

Figure 1:
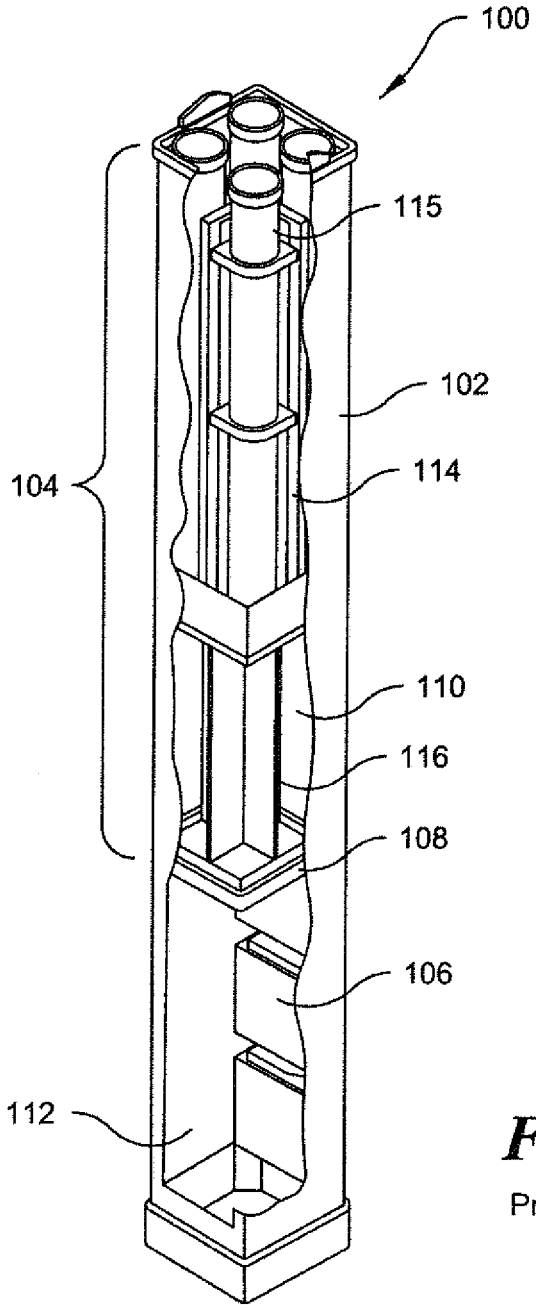
Fig. 1 Prior Art
FIG. 1 is a partial cut-away perspective view of an exemplary ALS according to the prior art.
Figure 2:
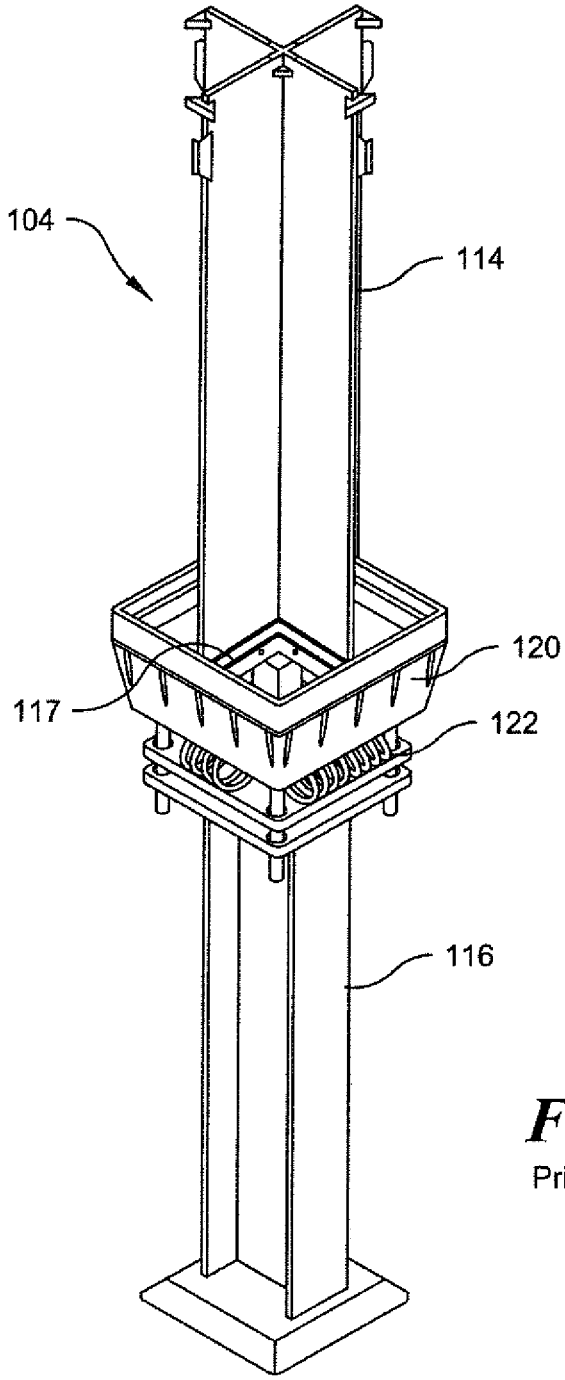
Fig. 2 Prior Art
FIG. 2 is a perspective view of a munitions adapter according to the prior art.
Figure 3:
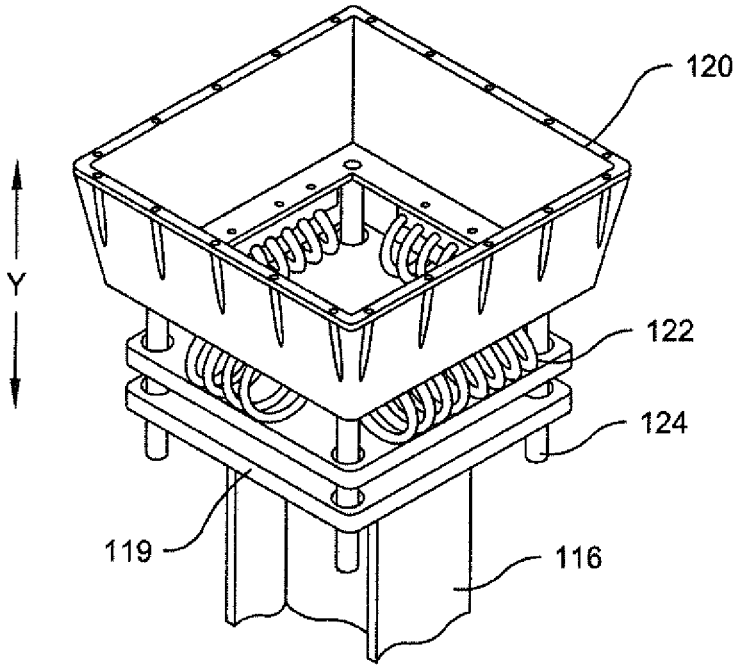
Fig. 3 Prior Art
FIG. 3 is a perspective view of a shock isolation skirt used in the munitions adapter of FIG. 2.

Referring generally to FIGS. 1-3, an exemplary ALS 100 of the prior art is shown and described herein. The ALS 100 includes a shell structure 102, munitions adapter 104, and launch control electronics 106. The shell structure 102 serves as a housing for munitions adaptor 104 and munitions 115 mounted thereto (e.g. missiles, active decoys, and unmanned aerial vehicles), and launch control electronics 106 which control the launch of the munitions 115.

The shell structure 102 further includes a sealing bulkhead 108, munitions compartment 110, and an electronics compartment 112. The sealing bulkhead 108 in conjunction with the shell structure 102 separates the munitions compartment 110 from the electronics compartment 112 and space external to the shell structure. Sealing bulkhead 108 also serves as part of the gas management system, preventing exhaust gases expelled from firing munitions from entering the electronics compartment 112. Moreover, the sealing bulkhead 108 provides the mounting surface for attaching and supporting the munitions adapter 104.

The munitions adapter 104 is located within the munitions compartment 110 and includes a munitions frame 114 and a munitions extension 116. The base of the munitions extension 116 mounts onto the sealing bulkhead 108. The munitions adapter 104 enables the ALS 100 to accommodate munitions 115 of different types sizes. Specifically, the length and configuration of the munitions extension 116 is varied based on the length and type of munitions 115 being used, allowing a single-sized shell structure 102 to house various types of munitions. Likewise, the munitions frame 114 may be unique to the type of munitions 115 used.

Referring generally to FIG. 2, a skirt 120 is mounted to the munitions extension 116 by vertical shock isolators 122, for example, coil springs and/or tubular shocks. The munitions frame 114 includes a base portion 117 configured to rigidly mount to the skirt 120. Thus, the skirt 120 and vertical shock isolators 122 provide a resilient coupling between the munitions frame 114 and the munitions extension 116.

With reference to FIG. 3, the skirt 120 is attached to a top portion 119 of the munitions extension 116 by the vertical shock isolators 122. Vertical guide elements 124 are provided to limit the movement of the skirt 120 in the lateral direction. The vertical shock isolators 122 provide a resilient compliance in the vertical direction (Y-direction as shown) between the munitions frame 114 (not shown) and the munitions extension 116, reducing the forces that would otherwise be transferred through the ALS 100 and underlying structure during a launch or Naval near miss explosive shock environments. This compliance is particularly important in shock environments, such as during missile firing or near-miss explosive shock testing, where significantly increased forces are exerted on the skirt 120, due to the induced shock event.

The top portion 119 of the munitions extension 116 generally comprises a plate-like surface suitable for mounting the vertical shock isolators 122 thereto. This arrangement prevents both the uninterrupted flow of expelled exhaust gases during firing, as well as underside access to the munitions 115 (FIG. 1). Expelled exhaust gases can reach temperatures in excess of 3000 degrees and can require at least two feet for the flow to become turbulent, and therefore less dangerous to the surrounding components. Accordingly, as the exhaust gases are expelled through the center of the skirt 120 by the firing munitions, they are directed into top portion 119, often melting, damaging, or otherwise destroying the top portion 119 and surrounding components including the shock isolators 122 and adjacent shell structure 102.

Further drawbacks of the above-described arrangement include time intensive and complex modification required to alter the shock isolation characteristics of the system. Moreover, as more shock isolation is needed, larger coil springs and/or dampeners may be required. However, the size of these components is limited by the relatively narrow space constraints of the shell structure 102. This results in less than ideal shock isolation. The vertical guide elements 124 are also prone to binding and corrosion in harsh environments.

In one aspect of the present invention, there is provided a simple, cost effective shock isolating system for use in an ALS that provides open underside access to the munitions frame, as well as an open passage for expelled exhaust gases. Accordingly, an embodiment of the present invention replaces the skirt, isolator, and munitions extension described above with a more efficient, interchangeable, and tunable design.

Figure 4:
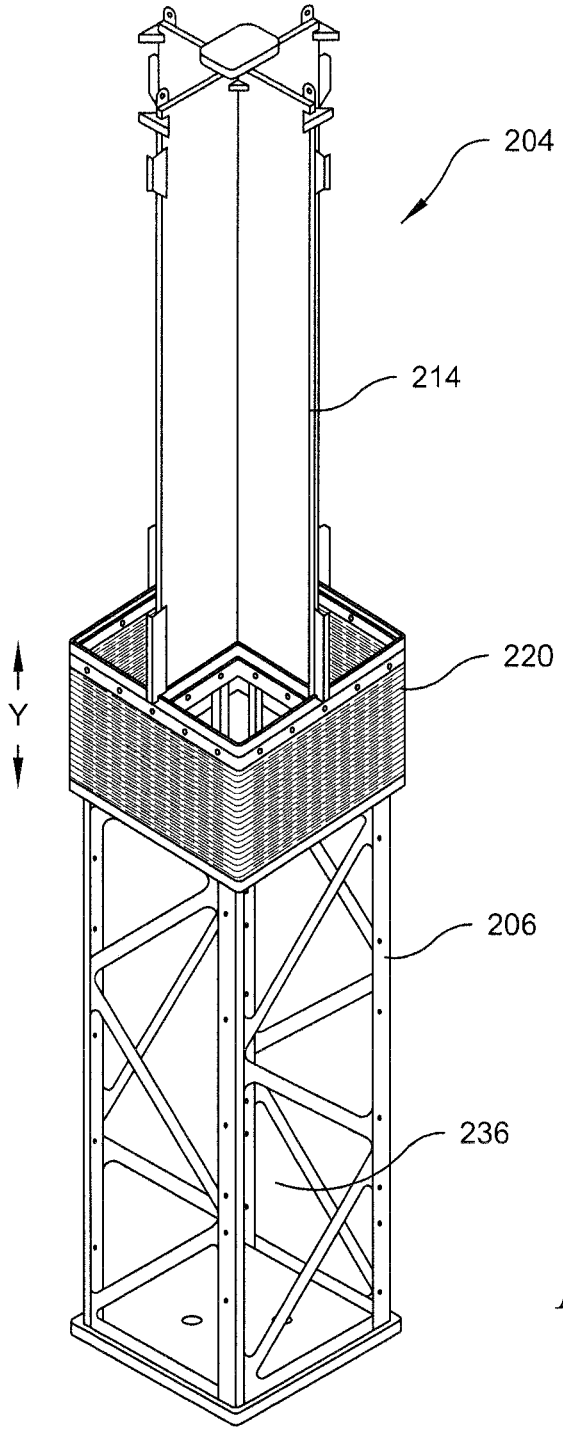
FIG. 4 is a perspective of a munitions adapter according to an embodiment of the present invention.

Referring generally to FIG. 4, a munitions adapter 204 according to an embodiment of the present invention is shown and described herein. The munitions adapter 204 includes spring plate skirt 220, a munitions frame 214, and a hollow munitions extension 206 supporting the spring plate skirt 220. The spring plate skirt 220 is preferably rigidly connected to the munitions extension 206 by conventional means, such as by bolts or other suitable fasteners. The spring plate skirt 220 is configured to resiliently support the munitions frame 214, thus replacing the skirt, shock isolators, and vertical guide elements of the prior art described above with respect to FIGS. 1-3. As described above with respect to the munitions adapter 104 of the prior art, the munitions frame 214 and the munitions extension 206 may be unique to the type of munitions utilized.

Figure 5:
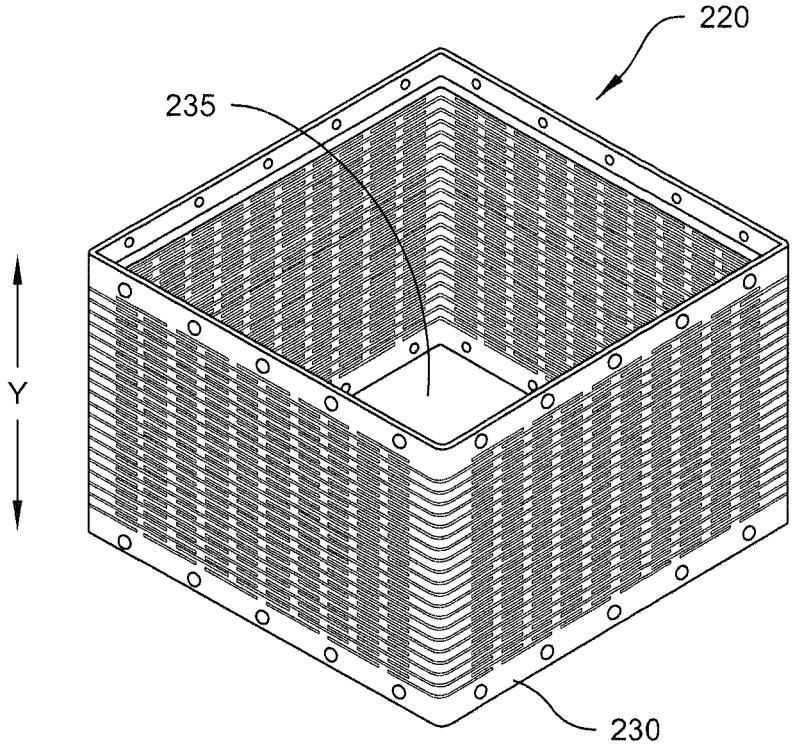
FIG. 5 is a perspective view of a spring plate skirt used in the munitions adapter shown in FIG. 4.
Figure 6:
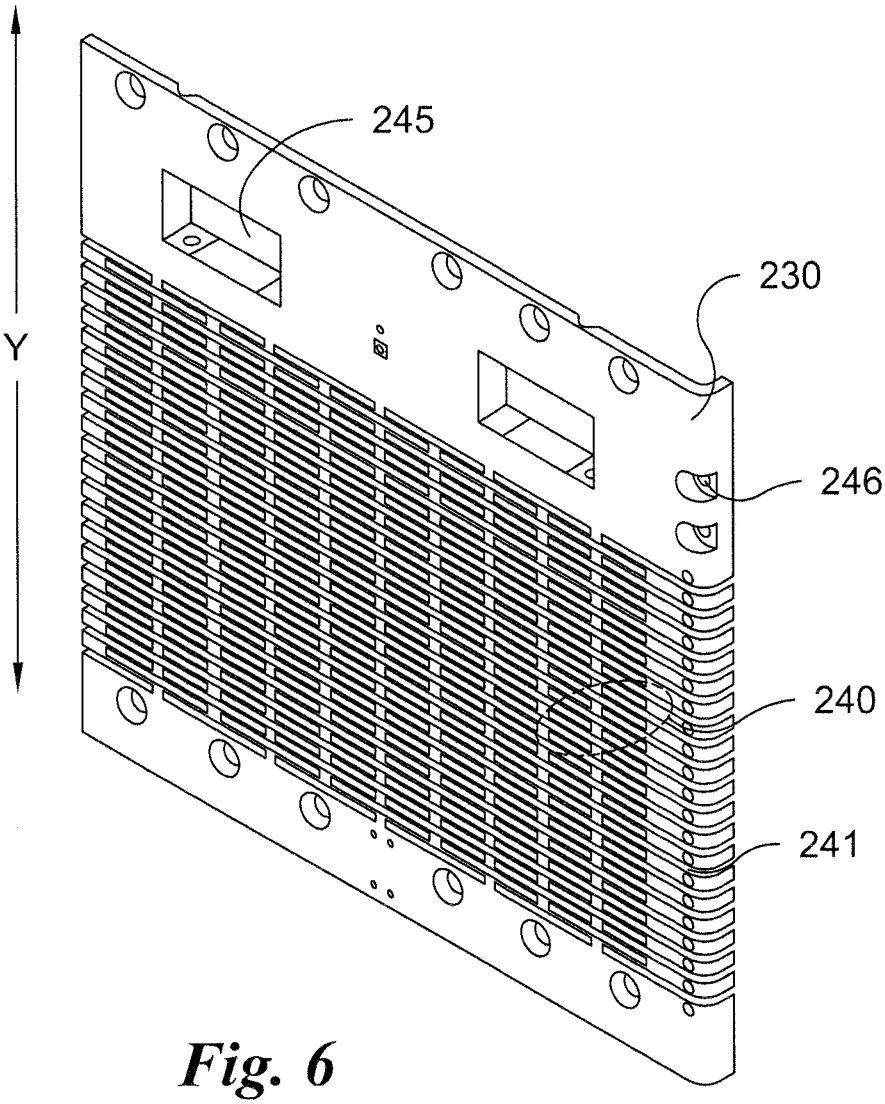
FIG. 6 is a perspective view of a portion of a spring plate skirt accordingly to an embodiment of the present invention.

With reference to FIG. 5, an exemplary spring plate skirt 220 is shown. In one embodiment of the present invention, the spring plate skirt 220 is a multi-sided structure comprised of support elements 230 (four as shown) configured to define an opening 235 therebetween, providing for the uninterrupted flow of expelled rocket gases. As described in detail with respect to FIG. 6 below, the support elements 230 provide a dynamic spring response, compressing generally in a Y-direction. Support elements 230 may comprise apertures 245 (FIG. 6) for mounting the munitions frame 214 thereto and may be fastened together to form the spring plate skirt 220 by conventional means, such as bolts arranged through apertures 246 (FIG. 6). This arrangement results in a rigid structure that provides improved lateral support needed for the munitions and munitions frame 214 during firing as well as at static conditions. The inherent stability of the boxed or otherwise enclosed arrangement eliminates the need for additional lateral support or guide provisions, such as vertical guide elements 124 of the prior art shown in FIG. 3, further reducing the cost and complexity while improving system reliability. While a four-sided skirt is shown, it is envisioned that any shape may be used, such as a circular or triangular arrangement, as well as any number of support elements, for example a single support element, without departing from the scope of the present invention.

With reference to FIG. 6, the dynamic spring response of the spring plate skirt 220 is provided by an integrated spring arrangement 240 formed within the support elements 230. Specifically, the support elements 230 feature voids, for example slots 241 formed therein. Each slot 241 acts as a spring beam such that each support element 230 acts as a spring plate, compressing generally in a Y-direction (FIGS. 4-7) in response to a load acting in a similar direction, such as the force created by a firing missile or Naval near miss explosive shock environment. The slots 241 also allow the passage of exhaust gases, further alleviating potential pressure build-up within the shell structure.

Figure 7:
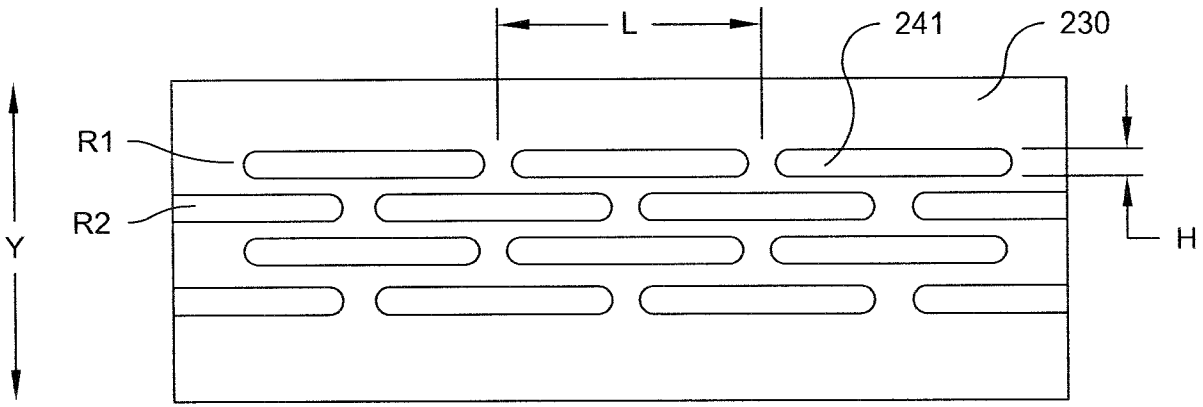
FIG. 7 is a schematic view showing the slots used to create an exemplary integral spring arrangement.

Referring generally to FIG. 7, the arrangement of the slots 241 determines the spring characteristics of the support elements 230. In the illustrated embodiment, the slots 241 are generally formed in horizontal rows R1, R2 and comprise a width L and a height H. The effective spring rate of the support element 230 is altered by changing the slot pattern, specifically by modifying the length and width of the slots 241, as well as their orientation with respect to one another. While an exemplary arrangement of the slot pattern is shown, it is envisioned that a variety of different voids, arranged in numerous configurations can be utilized to achieve a targeted spring effect for a particular application without departing from the scope of the present invention. The above-described arrangement has been shown to offer a significantly improved stroke to length ratio for a given effective spring rate compared to the coil springs used in the prior art.

In an exemplary configuration, the support elements 230 are approximately 1 inch (1") thick, 25" wide, and 12" to 18" in height, with a compression range of approximately 3" to 4", and an effective spring rate of around 2500 to 3500 in-lbs (inch-pounds). These parameters have been shown to be effective in Naval near miss explosive shock environment simulations to limit forces up to 30 G. It should be understood that these characteristics may be altered outside of these ranges depending on the type of munitions being used, as well as the desired performance criteria. For example, if a greater compression stroke or a greater amount of spring isolation is required, a replacement skirt with varied characteristics, such as a change in the height and/or slot pattern, can be easily substituted into the munitions adapter without the resulting reduction in space of the solutions of the prior art.

Support elements 230 can be economically produced, for example by using plate stock with the slots 241 formed by water-jetting or machining. In this way, a desired slot pattern may be programmed into either the water-jet or CNC mill for quick and accurate production of the support elements. Likewise, each support element 230 may be formed from multiple layers. For instance, two ½" thick plates may be machined with a particular slot pattern and arranged adjacent one another to reduce machining time and raw material cost. Support elements 230 can be formed from any suitable material such as steel, aluminum, metallic alloys, composites, rubbers, or other polymers. In a preferred embodiment, steel having a yield strength of approximately 80 ksi (kilo-pounds per square inch) is used to provide sufficient deflection before yielding. A nickel coating may be used for increased corrosion resistance in saltwater environments common for naval operations.

It is advantageous to form the spring plate skirt 220 from a material that can withstand the high temperatures produced by the rocket gases, so as to ensure the structural integrity of the skirt, and thus its holding capacity to prevent the munitions frame and munitions from separating from the skirt during a restrained fire. However, it is envisioned that other materials, such as rubbers or other polymers which may provide desirable shock isolating characteristics, can be used without departing from the scope of the present invention.

For example, in a more general embodiment of the present invention, an isolator, by way of example a rubber or foam isolator, defining an opening therethrough may be utilized in place of the spring plate skirt 220. The isolator would be arranged between the munitions extension and the munitions frame, providing a desired dynamic spring response therebetween. The isolator may include an integral support structure, such as steel inserts and/or a tether, to ensure the munitions frame separates from the isolator and/or the munitions extension in the event of a restrained firing. The isolator would preferably define an opening to allow for the passage of expelled gases during missile and munitions firing.

Referring again to FIG. 4, the munitions extension 206 may likewise be formed from water-jetted or machined plate, and fastened together by conventional means. Advantageously, the munitions extension 206 forms a hollow space 236 therein. The hollow space 236 and the opening 235 (FIG. 5) formed by support elements 230 create a singular open cavity below the firing ends of the munitions. As a result, unlike the solutions of the prior art, exhaust gases pass generally unobstructed as they expel downward, and are thus able to achieve undisturbed flow characteristics without contacting critical components, such as the munitions extension 206 or spring plate skirt 220. The open area defined by the hollow space 236 and the opening 235 also provides underside access to the munitions and munitions frame 214, eliminating the significant access problem with the solutions of the prior art.

With reference to any of the above embodiments, additional damping may be required beyond the inherent frictional damping of the system. Accordingly, in an alternate embodiment of the present invention, the system may further include various forms of dampening, for example, oil-filled shock isolators mounted to the spring skirt, or resilient material arranged within the voids formed in the support elements or on the surface of the spring plate assembly. The use of foam or other suitable materials within the voids of the support elements is further advantageous in that it can provide additional dampening without occupying critical space within the assembly.

While the foregoing embodiments describe the isolator or spring plate skirt of the present invention used in an exemplary ALS, it is envisioned that embodiments of the present invention may be retrofitted or designed into numerous alternative applications not described herein. For example, embodiments of present invention can be applied to any type of launch system requiring vertical shock isolation while providing similar benefits to those described above.

While the foregoing describes exemplary embodiments and implementations, it will be apparent to those skilled in the art that various modifications and variations can be made to the present invention without departing from the spirit and scope of the invention.

What is claimed is:

1. A shock isolation assembly for use in a launch system comprising:

a projectile mounting frame;

a base portion; and a shock isolator defining an opening therethrough, wherein the shock isolator is configured to resiliently attach the projectile mounting frame to the base portion; and wherein the shock isolator comprises at least one resilient support plate defining a circumferential wall, the at least one resilient support plate having a larger major surface and a smaller minor surface, the larger major surface extending in a direction generally vertically between the projectile mounting frame and the base, and the at least one resilient support plate having an integral spring arrangement formed therein.

2. The shock isolation assembly according to claim 1, wherein the integral spring arrangement comprises at least one void formed in the at least one resilient support plate.

3. The shock isolation assembly according to claim 2, wherein the at least one void comprises a plurality of voids configured to provide the at least one resilient support plate with a predetermined frequency response.

4. The shock isolation assembly according to claim 3, wherein the at least one resilient support plate is generally planar.

5. The shock isolation assembly according to claim 1, wherein the at least one resilient support plate comprises four resilient support plates arranged to form a four-sided skirt.

6. The shock isolation assembly according to claim 1, wherein the base portion defines a hollow space in communication with the opening defined by the shock isolator.

7. The shock isolation assembly accordingly to claim 1, wherein the opening defined by the shock isolator aligns with a firing end of a projectile arranged on the projectile mounting frame.

8. The shock isolation assembly of claim 7, wherein the opening defined by the shock isolator and the hollow space defined by the base portion define a continuous cavity.

9. The shock isolation assembly of claim 1, wherein the shock isolator comprises at least one aperture for attaching the projectile mounting frame thereto.

10. A shock isolating member for use in a vertical launch system comprising:

at least one resilient support plate defining a circumferential wall whose ends define an opening therethrough, said resilient support plate having an integral spring arrangement formed therein, the at least one resilient support plate having a first end configured to attach to a projectile mounting frame and a second end configured to attach to a base portion, the at least one resilient support plate having a larger major surface and a smaller minor surface, the larger major surface extending in a direction generally vertically between the projectile mounting frame and the base wherein the integral spring arrangement comprises a plurality of voids formed in the at least one resilient support plate, the plurality of voids configured to provide the at least one resilient support plate with a predetermined frequency response, and wherein the plurality of voids defined in the at least one resilient support plate form a pattern of voids arranged in rows and columns in said at least one resilient support plate.

11. The shock isolating member according to claim 10, wherein the integral spring arrangement comprises at least one void formed in the at least one resilient support plate.

12. The shock isolating member according to claim 11, wherein the at least one void comprises a plurality of voids configured to provide the at least one resilient support plate with a predetermined frequency response.

13. A shock isolating member for use in a vertical launch system comprising:

at least one resilient support plate defining a circumferential wall whose ends define an opening therethrough, said resilient support plate having an integral spring arrangement formed therein, the at least one resilient support plate having a first end configured to attach to a projectile mounting frame and a second end configured to attach to a base portion, wherein the integral spring arrangement comprises a plurality of voids formed in the at least one resilient support plate, the plurality of voids configured to provide the at least one resilient support plate with a predetermined frequency response, and wherein the plurality of voids defined in the at least one resilient support plate form a pattern of slots arranged in rows and columns in said at least one resilient support plate.

14. The shock isolating member according to claim 13, wherein at least some of said slots are configured to be of different dimensions.

15. The shock isolating member according to claim 10, wherein the at least one resilient support plate comprises four resilient support plates defining said circumferential wall.

16. The shock isolating member according to claim 15, wherein each resilient support plate is coupled to two other of said resilient support plates to define a rectangular configuration of said circumferential wall.

17. The shock isolating member according claim 10, wherein the at least one resilient support plate is generally planar.

18. A shock isolation assembly for use in a launch system comprising:

a projectile mounting frame;

a base portion; and a shock isolator defining an opening therethrough, wherein the shock isolator is configured to resiliently attach the projectile mounting frame to the base portion, wherein the shock isolator comprises at least one resilient support plate defining a circumferential wall, the at least one resilient support plate having an integral spring arrangement formed therein, wherein the integral spring arrangement comprises a plurality of voids formed in the at least one resilient support plate, the plurality of voids configured to provide the at least one resilient support plate with a predetermined frequency response, and wherein the plurality of voids defined in the at least one resilient support plate form a pattern of slots arranged in rows and columns in said at least one resilient support plate.

19. The shock isolation assembly according to claim 1, wherein the integral spring arrangement is configured to provide for deflection of the at least one resilient support plate in the vertical direction, along an axis arranged in a plane defined by the larger major surface of the support plate.

20. The shock isolation assembly according to claim 1, wherein the circumferential wall is one of a triangular and rectangular configuration.

21. The shock isolating member according to claim 10, wherein the circumferential wall is one of a circular, triangular, and rectangular configuration.

22. The shock isolation assembly according to claim 1, wherein the integral spring arrangement is formed in the larger major surface of the resilient support plate.

23. The shock isolation assembly of claim 1, wherein the shock isolator is configured to allow for motion of the projectile mounting frame along a vertical axis in a direction toward the base, and wherein the resilient support plate is configured to deflect in a direction parallel to the larger major surface of the resilient support plate, parallel to the vertical axis.

24. The shock isolating member according to claim 10, wherein the integral spring arrangement is formed in the larger major surface of the resilient support plate.

25. The shock isolating member according to claim 10, wherein the integral spring arrangement is configured to provide for deflection of the resilient support plate in the vertical direction parallel to a plane defined by the larger major surface of the resilient support plate.

* * * * *